US006663498B2

(12) United States Patent
Stipan

(10) Patent No.: US 6,663,498 B2
(45) Date of Patent: Dec. 16, 2003

(54) TILTABLE GOLF PLATFORM

(76) Inventor: Arthur R. Stipan, 1912 S. 146th St., Suite 102, Seattle, WA (US) 98168

( * ) Notice: Subject to any disclaimer, the term of this patent is extended or adjusted under 35 U.S.C. 154(b) by 0 days.

(21) Appl. No.: 10/002,767

(22) Filed: Nov. 13, 2001

(65) Prior Publication Data

US 2002/0119827 A1 Aug. 29, 2002

Related U.S. Application Data

(63) Continuation of application No. PCT/US00/13110, filed on May 12, 2000.

(60) Provisional application No. 60/178,691, filed on Jan. 28, 2000, and provisional application No. 60/134,087, filed on May 14, 1999.

(51) Int. Cl.[7] ..... A63B 57/00

(52) U.S. Cl. ..... 473/279; 473/278; 403/53; 403/58; 108/7

(58) Field of Search ..... 473/278, 279, 473/160, 161; 248/278.1, 371, 398; 108/7, 8; 403/52, 53, 57, 58

(56) References Cited

U.S. PATENT DOCUMENTS 4,262,891 A * 4/1981 Kinney ..... 269/71
4,875,684 A * 10/1989 Benilan ..... 473/279
5,340,111 A * 8/1994 Froelich ..... 108/7
5,358,251 A 10/1994 Ashton
5,460,379 A * 10/1995 Cleland ..... 473/279
5,470,074 A * 11/1995 Hotchkiss et al. ..... 473/279
5,527,042 A 6/1996 Spriddle
5,528,782 A * 6/1996 Pfeuffer et al. ..... 5/611
5,683,306 A 11/1997 Tait et al.
5,720,670 A 2/1998 Oxley et al.
5,820,478 A 10/1998 Wood et al.
5,944,615 A * 8/1999 Lee ..... 473/279
6,033,317 A 3/2000 Beam

* cited by examiner

*Primary Examiner*—S. Thomas Hughes
*Assistant Examiner*—Alex F. R. P. Rada, II
(74) *Attorney, Agent, or Firm*—Christensen O'Connor Johnson Kindness PLLC

(57) ABSTRACT

The present invention provides a golf practice device having a tiltable golf platform. In one embodiment, the platform is supported by an assembly that allows the platform to be controllably adjusted to simulate various golf lies. The device (200) includes a platform surface (250) mounted in a platform frame (202) that is affixed to a base frame (204) through a pair of actuators (205 and 206), each mounted to the base frame by a pivot block assembly (212) and affixed to the platform frame by an end block assembly (400). The platform frame is pivotally affixed to the base frame by a double cross-joint (203) mounted on the platform frame. The pivot block assemblies allow each actuator to adjust to the side angle relative to the actuator, thus allowing the platform to move freely in two different angles preventing unnecessary stress on the double cross-joint and the positions of attachment of the actuators to the base and platform frames.

22 Claims, 6 Drawing Sheets

TILTABLE GOLF PLATFORM

CROSS-REFERENCES TO RELATED APPLICATIONS

This application is a continuation of copending international application No. PCT/US00/13110, filed May 12, 2000, which claims the benefit of U.S. Provisional Patent Application No. 60/134,087, filed May 14, 1999, and U.S. Provisional Patent Application No. 60/178,691, filed Jan. 28, 2000. Priority of the filing dates is hereby claimed under 35 U.S.C. §120 and §119, respectively. Each of the above-identified applications is incorporated herein by reference in its entirety.

FIELD OF THE INVENTION

The present invention relates to a golf platform and, more particularly, to a tiltable golf platform.

BACKGROUND OF THE INVENTION

Golf practice tees and driving ranges offer a golfer an opportunity to practice and develop golfing skills. Practice tees are flat, horizontal surfaces on which the golfer stands and from which the golfer strikes the golf ball. Skills acquired at the practice tee or driving range are then applied on a golf course. Unlike the practice tee, the golf course includes a variety of terrain and a golf ball can come to rest on the course in a position other than a flat, horizontal playing surface. It is not uncommon for a golf fairway, rough, or sand trap to include mounds, hills, and depressions that challenge the golfer and that can require the golfer to strike the golf ball from other than a flat, horizontal surface.

Many golfers practice swinging a golf club at a driving range, where they may repeatedly strike a golf ball while standing in the same location. Because the golfer is standing in the same location, the ground at the player's feet is always the same level as the golf ball. The golfer is therefore unable to practice swinging on surfaces with various slopes. As noted above, because golf courses have hills or sloped areas, which generally increase the difficulty of the game, it is desirable for golfers to practice on a surface that simulates the terrain of an actual golf course. Inclined surfaces available at practice range will permit the golfer to vary her swing throughout the practice session and, therefore, make improved progress during practice.

Tiltable golf platforms are known in the art. For example, U.S. Pat. No. 5,340,111, issued to Froelich, describes a golf practice device that includes a platform on which a tiltable practice surface is connected to a base structure by a universal joint. The design described in the Froelich patent utilizes a pair of actuators operatively connected to both the base structure and the practice surface, so that movement of the actuator piston lifts the platform at an angle inclined to the ground. The actuators are directly mounted to the base structure and the practice surface by a pair of spherical bearings. The Froelich patent also describes a spherically shaped cowling that cooperates with a cylindrically shaped shroud to completely enclose the underside of the platform.

U.S. Pat. No. 2,937,875, issued to Mason et al., describes a golf practice apparatus which has a platform connected to a centrally located actuator. The platform has a plurality of hinge elements that become aligned with corresponding hinge elements of a base member. The platform is rotated to an inclined position by inserting a pin through the hinge elements on one side of the platform and then moving the actuator piston in an upward direction.

U.S. Pat. No. 4,875,684, issued to Benilan, describes a golf practice apparatus which has a base stand connected to a tiltable platform by a vertically positioned post and an annular member attached to the platform. The platform also includes two actuating jacks forming support and articulation elements. The platform in Benilan provides a structure that allows the support of a person while being relatively simple in construction and lightweight.

Although the above-described designs relate to a golf practice platform that allows one to practice at various angles, these designs suffer from various drawbacks. Included among these deficiencies is the general insufficiency of these devices to provide sufficient strength and stability to effectively support a golfer's weight. The previously designed platforms fail to provide stability when there is an increased amount of weight, such as the weight of two individuals, on the platform. Furthermore, there exists a need for a tilting mount assembly between a golf platform and its base, for tilting the platform relative to the base, that does not produce unnecessary wear on the tilting assembly as the platform is moved. The present invention seeks to fulfill this need and provides further related advantages.

SUMMARY OF THE INVENTION

The present invention provides a golf practice device having a tiltable golf platform. The platform can be tilted to create a variety of golf lies. The platform's tilt can be controlled by the golfer to simulate a variety of golf lies that may be encountered on a golf course. The platform can be installed at a golf practice or driving range.

In one embodiment, the platform is supported by an assembly that allows the platform to be controllably adjusted to simulate various golf lies. The device includes a platform surface mounted in a platform frame that is affixed to a base frame through a pair of actuators, each mounted to the base frame by a pivot block assembly and affixed to the platform frame by an end block assembly. The platform frame is pivotally affixed by a double cross-joint mounted to the base frame and affixed to the platform frame. The pivot block assemblies allow each actuator to adjust to the side angle relative to the actuator, thus allowing the platform to move freely in two different angles preventing unnecessary stress on the double cross-joint and the positions of attachment of the actuators to the base and platform frames.

The present invention provides a golf platform capable of stably supporting a considerable amount of weight. As with most golf practice areas, a practice session may include some instruction by a golf instructor who may provide instruction by assuming a stance close to the student golfer to demonstrate proper golf technique. Therefore, it is a feature of the present invention to provide a golf platform that is capable of bearing the weight of two persons with stability.

The present invention also provides a golf platform having a control panel for readily adjusting platform tilt. The control panel allows the golf to position the platform in any desired pitch or slope. Thus, various golf game conditions can be simulated by the device of the invention.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention provides a golf practice device having a tiltable golf platform. The platform's tilt can be controlled by the golfer to simulate a variety of golf lies typically encountered on a golf course. For example, the forward portion of the platform can be elevated (i.e., the platform front tilted upward) to create an uphill lie. Alternatively, the forward portion of the platform can be lowered (i.e., the platform front tilted downward) to create a downhill lie. Similarly, one or the other side of the platform can be raised (or lowered) to simulate sidehill lies. Combinations of elevations can also be simulated (e.g., downhill, sidehill and uphill, sidehill lies) by the platform. Thus, the device of the invention provides a platform that is continuously tiltable.

The platform includes a generally rectangular golfing surface having a forward portion (i.e., the direction the golfer faces when addressing and striking the golf ball) and a rearward portion. The platform's surface preferably includes a covering that simulates a grass surface (e.g., grass mat or artificial surface). The platform can also include controls accessible by the golfer for adjusting the tilt angle at which the golfer wishes to practice. The controls adjust the tilt of the platform to simulate uphill, downhill, sidehill lies, and combinations thereof. The controls activate a means for raising and/or lowering the platform. Any lifting and/or lowering means can be adapted to the device.

Advantages of the platform formed in accordance with the present invention include (1) the platform can be electronically controlled by the individual; (2) the platform can be included in an array of platforms, each of the platforms being either individually controlled or computer-controlled by, for example, a golf instructor; and (3) the platform can be combined with a virtual-reality headset or screen to simulate a golf course.

As shown in FIGS. 1A–1D, various lies including downhill, sidehill, and uphill lies can be simulated by the platform. The platform can be adjusted in all directions to simulate downhill, sidehill, and uphill lies as well as combination lies such as downhill, sidehill lies and uphill, sidehill lies.

Figure 1A:
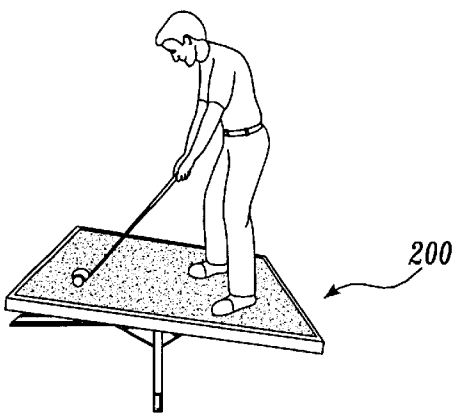
FIGS. 1A–1D are perspective views illustrating a representative device formed in accordance with the present invention for use at various tilt angles.
Figure 1B:
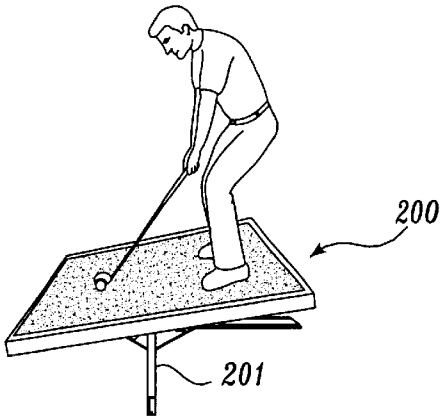
Figure 1C:
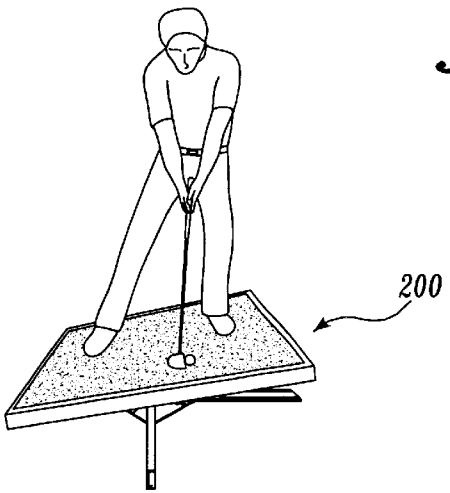
Figure 1D:
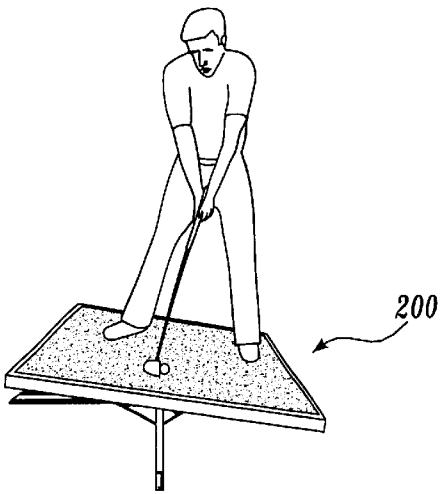
Figure 2:
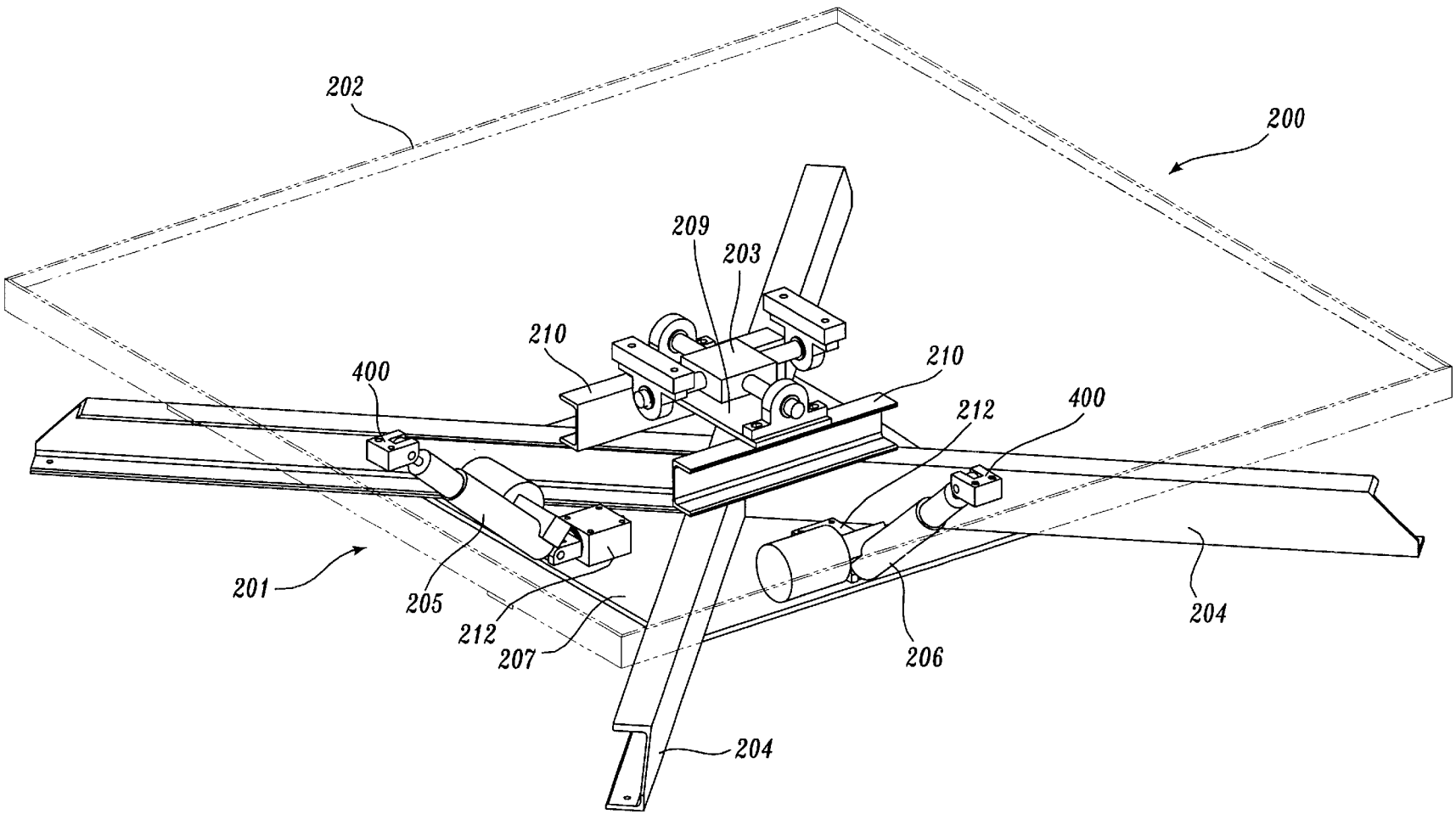
FIG. 2 is an exploded perspective view of a representative device formed in accordance with the present invention.

A representative device formed in accordance with the present invention is illustrated schematically in FIG. 2. Referring now to FIG. 2, device 200 includes base assembly 201 and platform frame 202 pivotally affixed to base 201 by double cross-joint assembly 203 and a pair of actuators 205 and 206. Base assembly 201 includes base frame 204 having two elongated members. Base frame 204 is mounted to base plate 207. Double cross-joint assembly 203 is mounted to base frame 204 through support assemblies 210.

Figure 7:
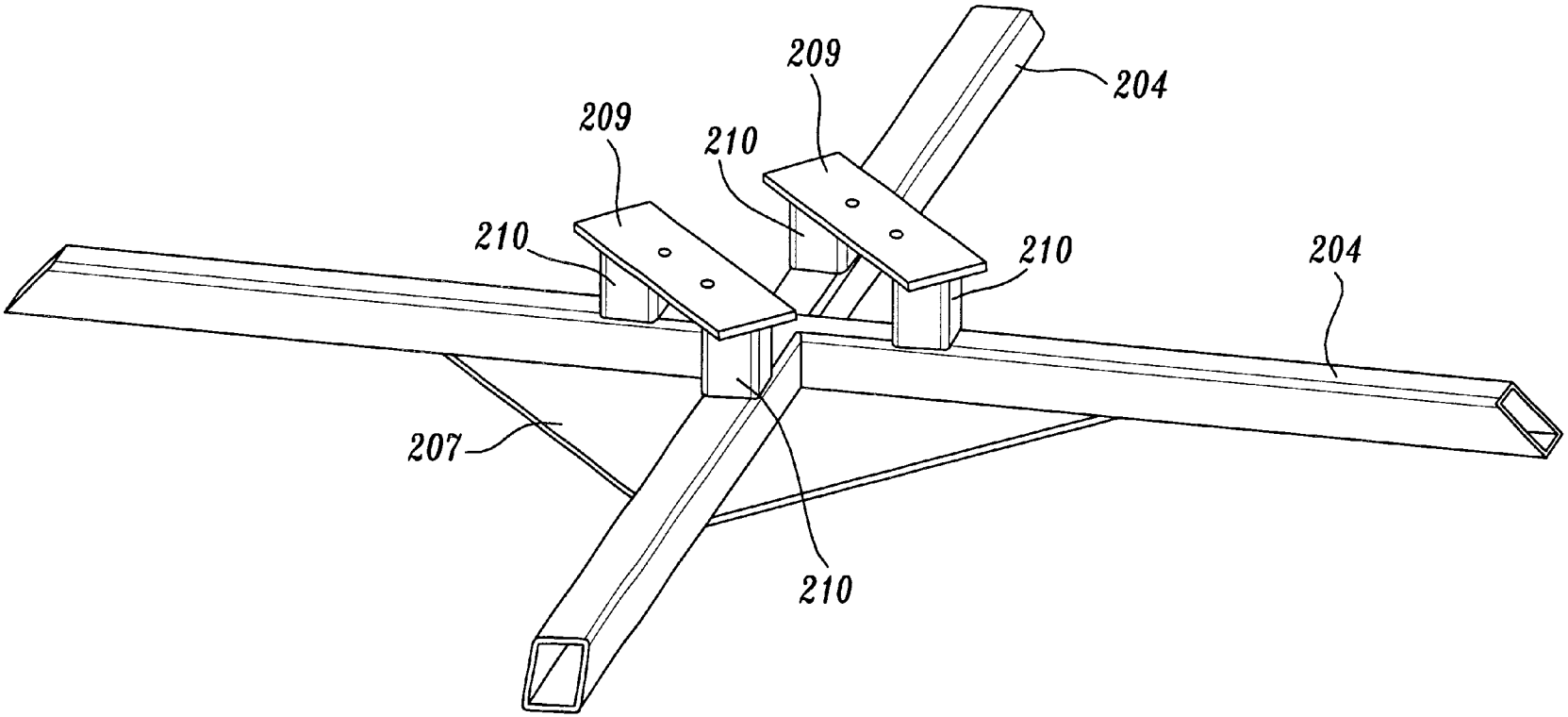
FIG. 7 is a perspective view of a portion of a representative base assembly for the device of the invention.

In one embodiment, base frame 204 and support assemblies 210 are U-channel members as illustrated in FIG. 2. In another embodiment, the base frame includes tubular elongated members. A portion of a base assembly is illustrated in FIG. 7. Referring to FIG. 7, base frame 204 includes tubular elongated members and support assemblies 210 are individual supports spanned by support plate 209 to which double cross-joint assembly 203 is mounted.

Actuators 205 and 206 each include a positionally fixed end and an extendable/retractable end. Actuators 205 and 206 positionally fixed ends are mounted to base plate 207 through pivot block assemblies 212 affixing each actuator to base 201. Pivot block assemblies 212 allow one actuator to adjust to a side angle that is created by the movement of the other actuator, while allowing each actuator to be securely affixed to the base plate 207 and platform frame 202.

In certain conventional golf platform designs, actuators are mounted to the base assembly by the use of standard ball joints. Prior designs using such standard ball joints create mounting assemblies that allow free movement of the platform regardless of the position or angle of the platform. In some cases, this free movement, or loose fit, allows the platform to shift when a user moves or shifts her weight while on the platform. Moreover, when the weight on the platform is increased, such as when an instructor stands on the platform with a student, the free movement is magnified. The pivot block assemblies of the device of the present invention provide a rigid mount for the actuators while at the same time allowing the platform to move without undue stress on the device's moving components or frame. The pivot block assembly allows for actuator movement in unison with actuator extension and retraction. Such range of motion reduces wear on the device's components.

Figure 3:
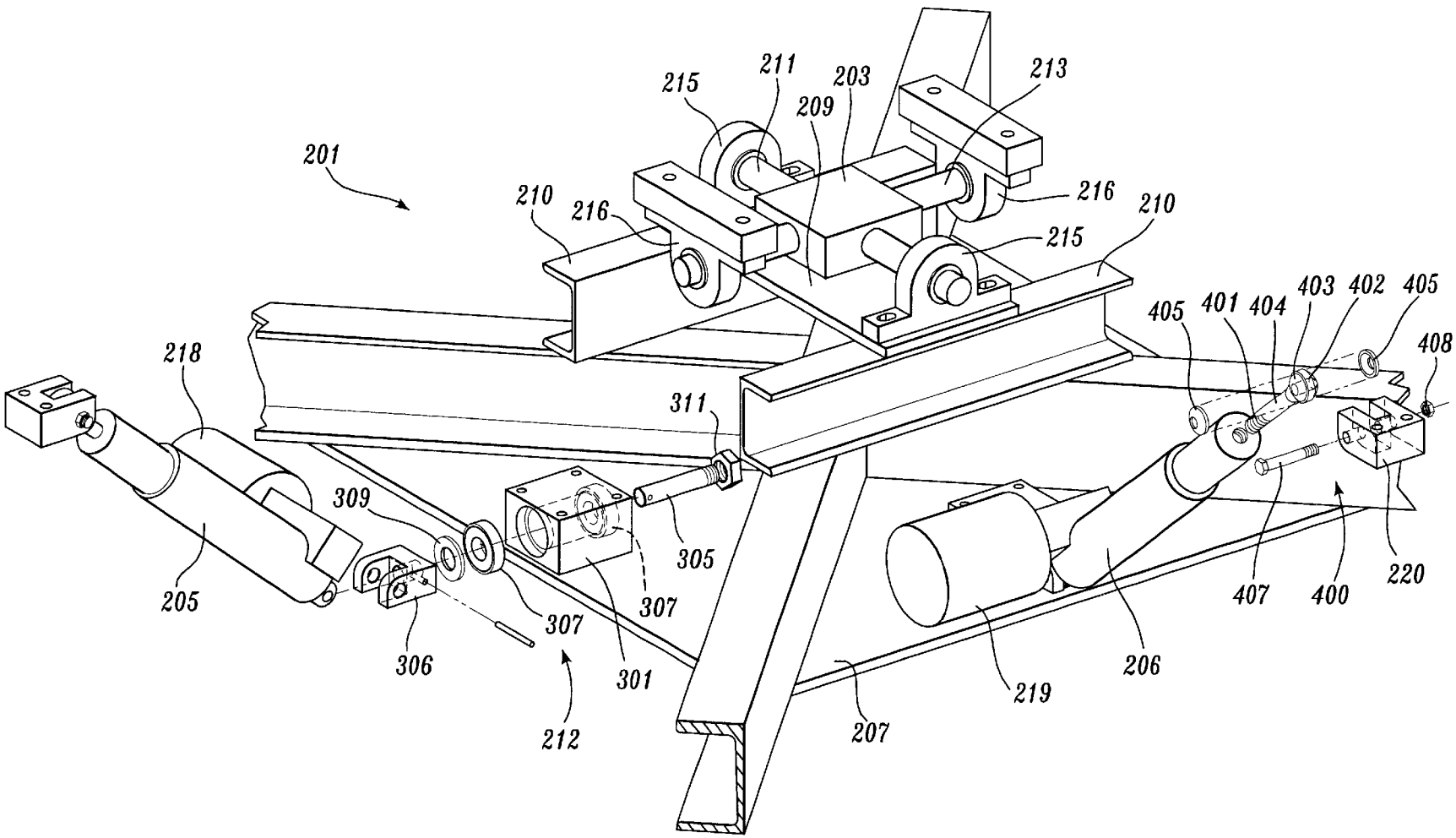
FIG. 3 is an exploded perspective view of a portion of a representative base assembly formed in accordance with the present invention illustrating the pivot block and end block assemblies.

A portion of a representative base assembly useful in the device of the invention is illustrated schematically in FIG. 3. FIG. 3 provides an exploded view of a representative pivot block assembly. Referring to FIG. 3, pivot block assembly 212 includes housing 301, elongated axle member 305, bearing rings 307, washer 309, nut 311, and clevis 306. As shown in FIG. 3, housing 301 includes a channel therethrough sized to receive bearing rings 307 positioned at opposite sides of the channel. Bearing rings 307 are arranged for receiving elongated axle member 305 such that member 305 extends through housing 301 and is free to rotate about its center. Elongated axle member 305 is secured in place by nut 311 and clevis 306. Nut 311 and clevis 306 can be attached by a thread grooved into elongated axle member 305, or by other attachment, such as, for example, a weld or metal adhesive. Alternatively, nut 311 can be replaced by another locking device such as, for example, a cotter pin.

Housing 301 also includes a plurality of mounting apertures sized to receive mounting bolts and arranged such that the mounting apertures do not penetrate the housing to the channel supporting bearing rings 307 and elongated axle member 305. Bolts can be used to mount housing 301 to base plate 207.

Clevis 306 is adapted to receive the positionally fixed end of actuator 205 or 206. In such an assembly, the actuator is torsionally affixed to the base plate. Such an assembly allows each actuator to move and position platform frame 202 in various angled positions while providing rigid support for the platform frame 202 at all angles.

The device's components can be made from 1018 cold rolled steel that is zinc plated.

Actuators 205 and 206 each include an extendable/retractable end that is mounted to platform frame 202 through end block assemblies 400. Extension of the actuator from a retracted position elevates the platform at the point at which the actuator is affixed to the platform frame. Conversely, retraction of the actuator from an extended position lowers the platform at the point at which the actuator is affixed to the platform frame.

Each actuator is attached to the platform frame by an end block assembly. The end block assembly can include a ball joint. A representative end block assembly useful in the device of the invention is illustrated in FIG. 3. Referring again to FIG. 3, end block assembly 400 includes threaded ring loop 404 having threaded shaft 401, looped end 402, and ball 403 frictionally affixed within the looped end. Ball 403 includes an aperture centered therethrough. Threaded ring loop 404 can be secured within compression washers 405 adapted to fit about ball 403. Compression washers 405 provide additional stability for platform frame 202 further reducing undesirable movement of the platform surface as weight shifts by a user. The ball can be made from a variety of materials including metals such as steel. The compression washers can be formed from resilient materials including rubber such as 70 durometer rubber. The aperture in ball 403 is sized to receive bolt 407, which, in combination with nut 408, fixes threaded ring loop 404 to platform frame 202 through a coupling assembly with apertures sized to receive mounting bolt 407. The coupling assembly can be any one of a variety of assemblies suitable for securing the threaded ring loop to the platform frame. The coupling assembly can be block assembly 220 as illustrated in FIG. 3, or alternatively, metal brackets. Block assemblies 220 are aligned with members on platform frame 202 and fixed to the frame by welding, bolting, or other bonding.

In the device, a joint assembly serves to allow tilting of the platform about two axes with respect to the base. Referring again to FIG. 3, double cross-joint assembly 203 acts to allow tilting of the platform frame with respect to a base 201 about two axes as defined by pivotal connections 211 and 213, respectively. Double cross-joint assembly 203 includes a first pair of pillow blocks 215 mounted to support assemblies 210 through support plate 209. Pillow blocks 215 are arranged on support assemblies 210 to receive elongated shaft 211 and to allow the shaft to rotate freely about its axis. Double cross-joint assembly 203 also includes a second pair of pillow blocks 216 mounted to platform frame 202. Pillow blocks 216 are arranged to receive elongated shaft 213. Double cross-joint assembly 203 includes a double-axle center that allows for the combination of the two sets of pillow blocks 215 and 216 and shafts 211 and 213 to be arranged to create two rotation axes that are at right angles with respect to each other.

Figure 4:
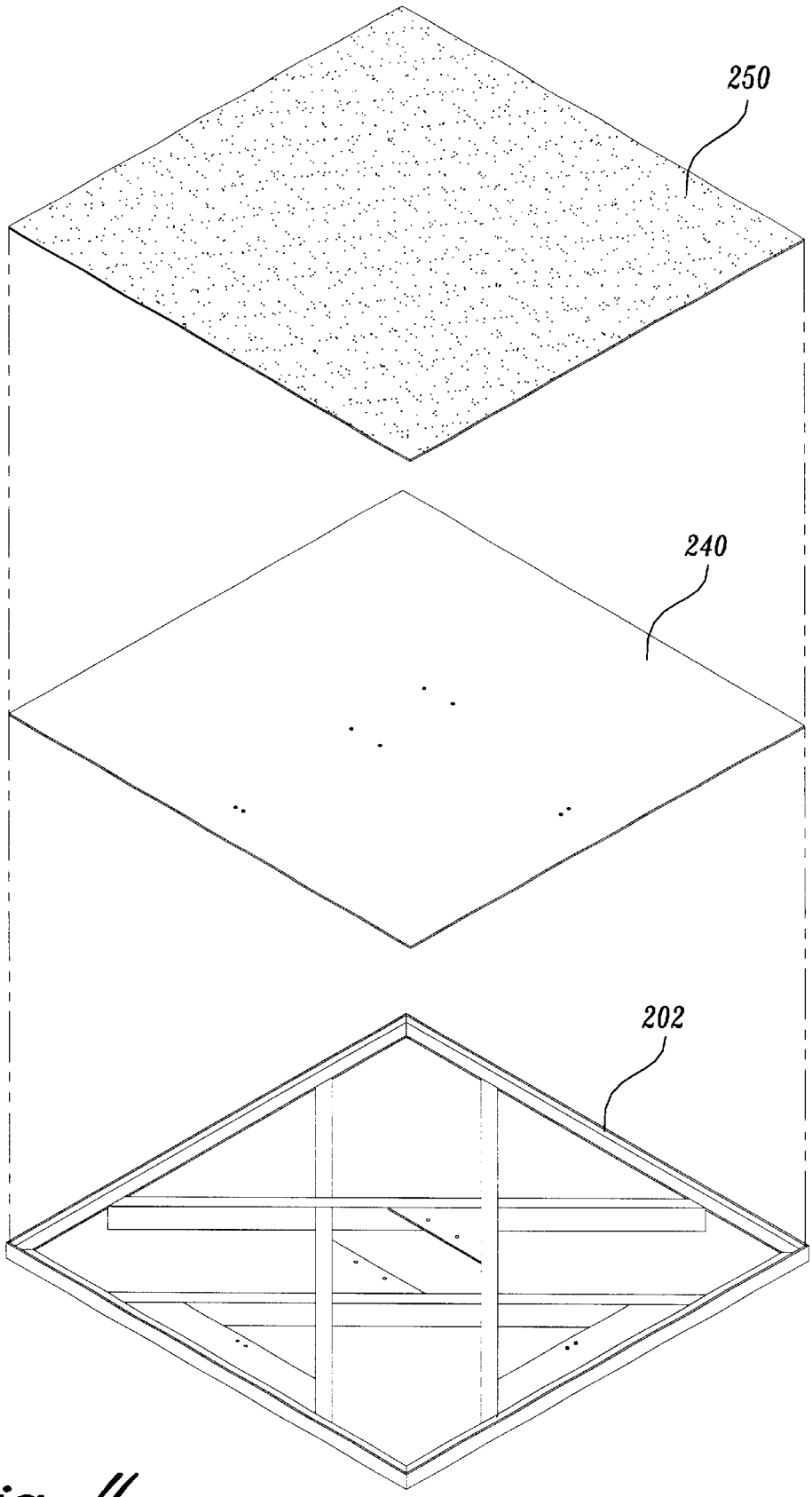
FIG. 4 is an exploded view of a representative platform assembly for the device of the invention.

The platform includes a generally rectangular golfing surface having a forward portion (i.e., the direction the golfer faces when addressing and striking the golf ball) and a rearward portion. As shown in FIGS. 1A–1D, the platform's surface preferably includes a covering that simulates a grass surface (e.g., a grass mat or an artificial grass texture). Referring to FIG. 4, surface 250 is affixed to surface plate 240, which is in turn affixed to the platform frame 202. Surface plate 240 can made of a substantially rigid material such as steel, aluminum, or formed plastic. In one embodiment, surface 250, plate 240, and frame 202 are sized to allow one person to stand on the platform and swing a golf club. In another embodiment, surface 250, plate 240, and frame 202 are sized to allow two persons to stand on the platform. Surface plate 240 can be attached to platform frame 202 in any one of a variety of ways. For example, plate 240 can be attached to platform frame 202 and secured by, for example, welds, bolts, screws, adhesives, and the like.

Figure 5:
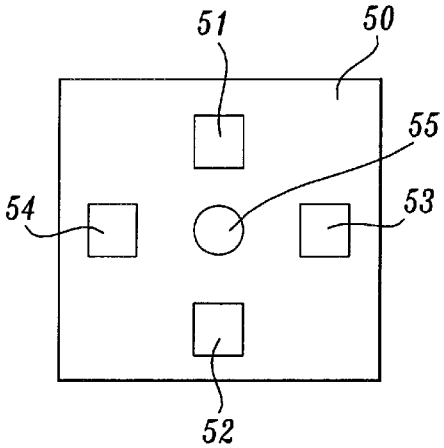
FIG. 5 is a top view of a representative control panel for adjusting the tilt of the platform of the device of the invention.

The platform can also include a control panel accessible by the golfer for adjusting the tilt angle at which the golfer wishes to practice. Referring to FIG. 5, in one embodiment, control panel 50 includes four buttons 51, 52, 53, 54 for simulating uphill, downhill, and sidehill lies. In another embodiment, the control panel 50 also includes a fifth button 55 for resetting the platform to a horizontal position. The controls provide a means for raising and/or lowering platform 202. A plate cover can optionally be placed over the control panel and configured such that when the user depresses one area of the plate cover, the plate cover may depress one or more buttons. The plate cover allows a user to move the platform into an angle by pressing one area of the plate instead of, for example, two separate buttons. Alternatively, the control panel can be a touch-activated sealed board panel (Wilson Hurd, Wausau, Wis.) which allows for continuous platform tilt adjustment (e.g., combinations of forward or rearward elevation or lowering and left or right elevation or lowering).

Figure 6:
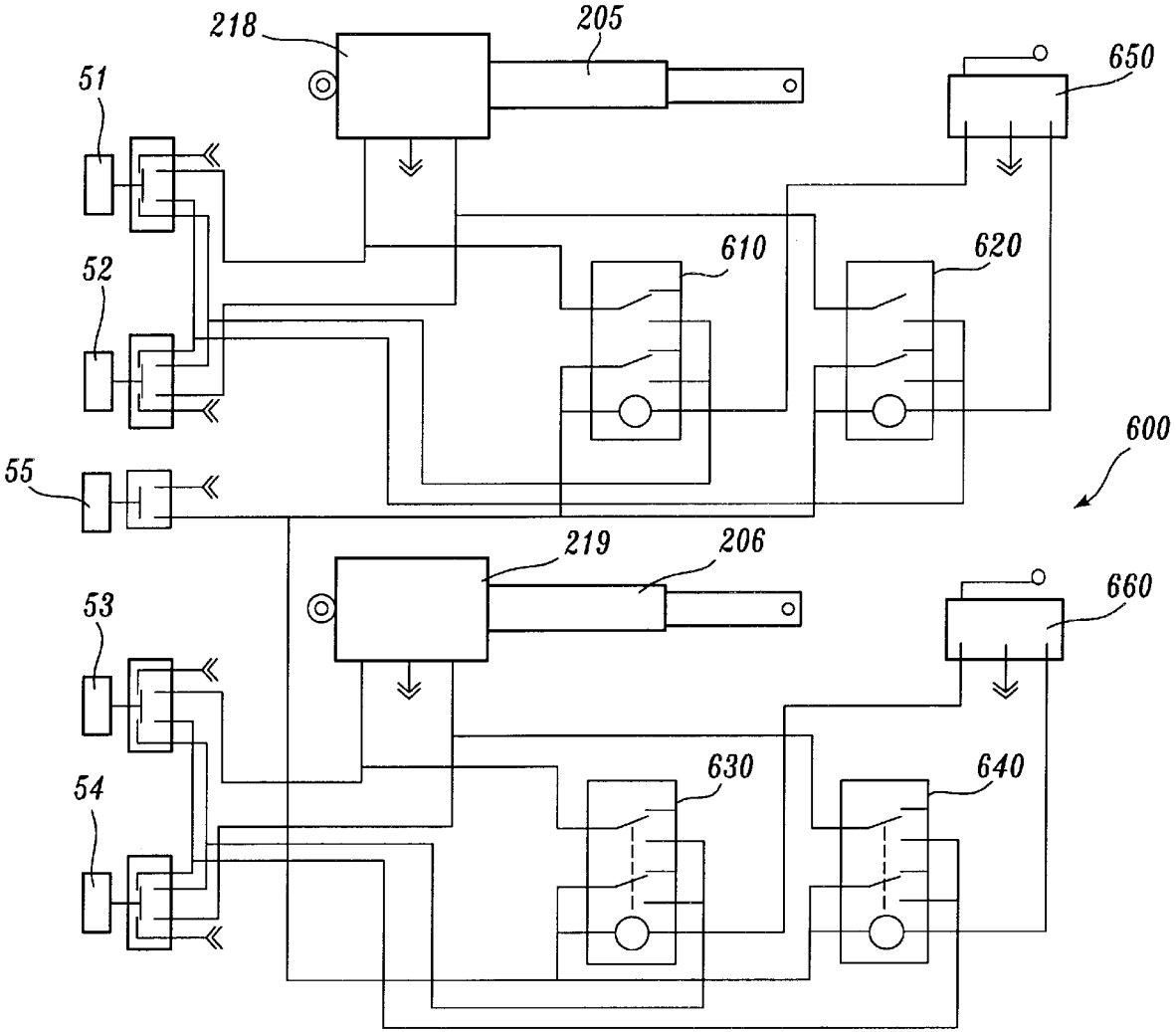
FIG. 6 is a schematic diagram of a representative platform control circuit for operating the device of the invention.

A representative electrical circuit for controlling the device of the invention is illustrated in FIG. 6. Referring to FIG. 6, in one embodiment, control circuit 600 includes two electronic actuators 205 and 206 with motors 218 and 219, respectively. Although electronic actuating devices are described in this embodiment, other types of actuating devices can be used, including, for example, hydraulic or air pump actuators. These actuators can be configured with the circuit as shown in FIG. 5 so the user can depress one or more of buttons 51, 52, 53, 54, and 55 to adjust the tilt of the platform.

Referring to FIG. 6, motors 218 and 219 power actuators 205 and 206, respectively. Actuator 205 can be extended by activating control 51 (for example, extension resulting in raising the right side of the platform) and retracted by activating control 52 (for example, retraction resulting in lowering the right side of the platform). Similarly, actuator 206 can be extended by activating control 53 (for example, extension resulting in raising the forward portion of the platform) and retracted by activating control 54 (for example, retraction resulting in lowering the forward portion of the platform). Activation of control 55 levels the platform. Circuit 600 includes switches 610 and 620 for controlling actuator 205, and switches 630 and 640 for controlling actuator 206. Circuit 600 also includes actuator 205 level limit switch 650 and actuator 206 level limit switch 660.

In other embodiments, the device of the invention can be operated as a pay-for-play device. In such an embodiment, the platform's actuators become operable for a period of time only after activation by, for example, a credit card or the insertion of currency. For these embodiments, the device includes a means for receiving either a credit card or currency coupled to a timing device that renders the platform operable for a designated period of time after receipt of either the credit card or currency.

The device can be advantageously installed at a golf driving or practice range. The driving range can include one or more devices operable as a pay-for-play device as described above. Alternatively, the device or devices can be centrally controlled by a computer. The central control of a plurality of devices is particularly useful for group golf lessons.

The device of the invention provides a tiltable platform useful in practicing golf shots at other than horizontal positions. The device advantageously provides a tiltable platform that is positionally stable to the user's weight shifts. The device also has positional stability sufficient to support the weight of more than one person allowing an instructor to assume a stance in proximity to a golfing student. The platform's stability is attributable to its design and components. More specifically, platform stability is achieved through the utilization of the various features of the device including the double cross-joint assembly pivotally affixing the platform to the base, the pivot block assemblies mounting the actuators to the base, and the end block assemblies that attach the extendable/retractable ends of the actuators to the platform.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A device having a tiltable platform, consisting essentially of:

(a) a platform pivotally attached to a base through a joint assembly, wherein the joint assembly comprises a double cross-joint assembly that provides the platform with two perpendicular axes of rotation whereby the platform is continuously tiltable with respect to the base;

(b) a first adjustable linear actuator having a positionally fixed end mounted to the base and an extendable/retractable end attached to the platform;

(c) a second adjustable linear actuator having a positionally fixed end mounted to the base and an extendable/retractable end attached to the platform;

(d) a first pivot block assembly for connecting the first actuator to the base; and (e) a second pivot block assembly for connecting the second actuator to the base.

2. A device having a tiltable platform, comprising:

(a) a platform pivotally attached to a base through a joint assembly, wherein the joint assembly comprises a double cross-joint assembly that provides the platform with two perpendicular axes of rotation whereby the platform is continuously tiltable with respect to the base;

(b) a first adjustable linear actuator having a positionally fixed end mounted to the base and an extendable/retractable end attached to the platform;

(c) a second adjustable linear actuator having a positionally fixed end mounted to the base and an extendable/retractable end attached to the platform;

(d) a first pivot block assembly for connecting the first actuator to the base, wherein the first pivot block assembly comprises:

(1) a housing having an aperture therethrough;

(2) an elongated axle member slidably insertable into the aperture; and (3) a clevis attached to one end of the elongated axle member and to the first actuator; and (e) a second pivot block assembly for mounting the second actuator to the base, wherein the pivot block assembly comprises:

(1) a housing having a channel therethrough;

(2) an elongated axle member slidably insertable into the aperture; and (3) a clevis attached to one end of the elongated axle member; and to the base.

3. The device of claim 2 further comprising first and second bearing rings for securing the elongated axle member inside the housing.

4. The device of claim 2, wherein the first pivot block assembly allows the first actuator to adjust to a side angle that is created by the movement of the second actuator and wherein the second pivot block assembly allows the second actuator to adjust to a side angle that is created by the movement of the first actuator, whereby the wear on the devices components is reduced.

5. The device of claim 2, wherein the first actuator is attached to the platform through an end block assembly comprising a ball joint and wherein the second actuator is attached to the platform through an end block assembly comprising a ball joint.

6. The device of claim 5, wherein each of the ball joints comprises a pair of compression washers adapted to fit about the ball joint ball.

7. The device of claim 2, wherein each of the actuators comprises an electric actuator.

8. The device of claim 2, wherein each of the actuators comprises a hydraulic actuator.

9. The device of claim 2, wherein each of the actuators comprises an air pump actuator.

10. The device of claim 2, wherein the platform simulates a downhill golf lie.

11. The device of claim 2, wherein the platform simulates an uphill golf lie.

12. The device of claim 2, wherein the platform simulates a sidehill golf lie.

13. The device of claim 2, wherein the platform has a size sufficient for a single user.

14. The device of claim 2, wherein the platform has a size sufficient for a two persons.

15. The device of claim 2, further comprising a control panel for adjusting platform tilt.

16. The device of claim 15, wherein the control panel comprises four controls for adjusting platform tilt.

17. The device of claim 15, wherein the control panel comprises a control for returning the platform to a horizontal position.

18. The device of claim 2, wherein the actuators become operable on activation with a credit card.

19. The device of claim 2, wherein the actuators become operable on activation with currency.

20. The device of claim 2, wherein the platform comprises a surface having a simulated grass surface.

21. A golf driving range comprising a device of claim 2.

22. A plurality of devices according to claim 2, wherein the devices are centrally controlled by computer.

* * * * *

UNITED STATES PATENT AND TRADEMARK OFFICE

CERTIFICATE OF CORRECTION

PATENT NO. : 6,663,498 B2
DATED : December 16, 2003
INVENTOR(S) : A.R. Stipan

It is certified that error appears in the above-identified patent and that said Letters Patent is hereby corrected as shown below:

Column 8,
Line 8, “member; and” should read -- member and --
Line 18, “devices components” should read -- device’s components --

Signed and Sealed this

Nineteenth Day of April, 2005

JON W. DUDAS
*Director of the United States Patent and Trademark Office*